US005727524A

United States Patent [19]

Aoyama

[11] Patent Number: 5,727,524

[45] Date of Patent: Mar. 17, 1998

[54] CYLINDER HEAD FOR MULTI-VALVE ENGINE

[75] Inventor: Tateo Aoyama, Iwata, Japan

[73] Assignee: Yamaha Hatsudoki Kabushiki Kaisha, Iwata, Japan

[21] Appl. No.: 564,775

[22] Filed: Nov. 29, 1995

[30] Foreign Application Priority Data

Nov. 30, 1994 [JP] Japan ..... 6-297197

[51] Int. Cl.[6] ..... F02B 1/00

[52] U.S. Cl. ..... 123/432

[58] Field of Search ..... 123/308, 302, 123/432, 90.27, 193.5, 90.48

[56] References Cited

U.S. PATENT DOCUMENTS 4,637,357 1/1987 Ohmi ..... 123/90.27
4,660,529 4/1987 Yoshikawa ..... 123/432
4,667,636 5/1987 Oishi et al. ..... 123/432
5,094,197 3/1992 Rosa ..... 123/90.27
5,095,858 3/1992 Ascari ..... 123/308
5,385,125 1/1995 Oyaizu et al. ..... 123/90.27
5,462,027 10/1995 Aoyama ..... 123/432

*Primary Examiner*—Marguerite McMahon
*Attorney, Agent, or Firm*—Knobbe, Martens, Olson & Bear LLP

[57] ABSTRACT

A five valve per cylinder twin overhead cam internal combustion engine wherein the valve placement is such that the cam shafts may be located so as to directly operate the valves and still provide threaded fastener attachments that can be tightened when the cam shaft is in place. The placement of the valves and the size of their actuating tappets is such to maintain optimum strength and durability while maintaining a compact construction.

25 Claims, 8 Drawing Sheets

CYLINDER HEAD FOR MULTI-VALVE ENGINE

BACKGROUND OF THE INVENTION

This invention relates to an improved cylinder head and more particularly to a cylinder head for a multiple valve internal combustion engine.

In internal combustion engines, it has been recognized that the breathing ability and performance of an engine can be significantly improved by utilizing multiple valves. For this reason, four valve per cylinder engines are commonly used. Such engines have two intake and two exhaust valves for each cylinder. Although the use of these engines was previously limited to high performance racing engines, many conventional passenger car engines now employ four valves per cylinder.

By utilizing more valves per cylinder rather than individual large valves, the effective flow area can be maintained while the inertia of the individual components reduced. This permits operation of the engine at higher speeds and the obtaining of higher power output.

It has also been recognized that further improvements in performance can be obtained by utilizing five valves per cylinder. Such five valve engines normally employ three intake valves and two exhaust valves per cylinder. However, the addition of the further intake valve give rise to problems which are not attendant with four valve per cylinder engines and which must be addressed.

With four valve per cylinder engines, the valves can be symmetrically positioned and all of the intake valves and all of the exhaust valves are operated by a respective cam shaft. Because of the symmetric positioning, the cylinder head fasteners can be assessable even when the camshafts are in place. In addition, relatively large tappet bodies may be employed for operating the valves without necessitating comprises in the cylinder head configuration to accommodate the various components.

Where, however, three intake valves per cylinder are employed the positioning of the valves is important. That is, it is relatively easy to add a third intake valve to the engine but doing so results in larger cylinder head surfaces forming the combustion chamber, large volumes, greater quenching and lower compression ratios.

Therefore, it has been proposed to position the three intake valves in such a manner that there is provided a center intake valve and a pair of side intake valves. The axes of reciprocation of the side intake valves lie in a common plane while that of the center intake valve is disposed at an angle to this plane. Conventionally and in order to obtain high compression ratios and low surface areas, it has been the practice to have the angle of the plane and the angle of reciprocation of the center intake valve at relatively shallow acute angles to a plane containing the cylinder bore axis. These acute angles also all lie on the same side of this plane. By appropriately positioning the valves, their valve stem axes may be disposed so that they all can be operated by a common intake camshaft through thimble tappets.

Although this result is obtainable, it generally results in the positioning of the intake camshaft in such a location that it overlies or obscure the axis and heads of the cylinder head fasteners. Obviously, this presents some difficulties from a service standpoint.

Also, when three intake valves are utilized and they are all actuated by thimble tappets, then the thimble tappets must be relatively small in diameter to avoid interference. This can increase unit stress and wear.

It is, therefore, a principal object to this invention to provide an improved cylinder head arrangement for internal combustion engine employing multiply and at least three intake valves per cylinder.

It is a further object to this invention to provide a cylinder head assembly for such a multiple valve engine wherein the valves are positioned in such a way so as to maintain low surface areas and high compression ratios.

It is a further object to this invention to provide a cylinder head arrangement for such an engine wherein the camshafts may be positioned so that only two camshafts are required for operating all five valves and so that the camshafts are positioned so that they do not obscure the cylinder head fasteners.

It is a still further object to this invention to provide a multi-valve cylinder head arrangement wherein the diameters of the respective valve actuating tappets may be maintained as large as possible without interference between them.

SUMMARY OF THE INVENTION

A first feature of the invention is adapted to be embodied in a an internal combustion engine that is comprised of a cylinder block forming at least one cylinder bore and a cylinder head which defines a crankcase chamber recess in facing relationship to the cylinder bore to form a combustion chamber. A plurality of intake valves are supported on one side of the cylinder head recess in the cylinder head for controlling the admission of a charge to the combustion chamber. A plurality of exhaust valves are supported on the other side of the cylinder head recess in the cylinder head for controlling the discharge of a burnt charge from the combustion chamber. An intake camshaft is rotatable on the one side of the cylinder head about a longitudinally extending axis and directly operates the intake valves. An exhaust camshaft is rotatably journaled on the other side of the cylinder head about a longitudinally extending axis parallel to the axis of the intake camshaft and directly operates the exhaust valves. One of the camshaft rotational axes is disposed substantially closer to a plane containing the axis of the cylinder bore than the other. A first series of threaded fasteners have their axes lying on a common plane that is spaced outwardly of the rotational axis of the one camshaft and are accessible when the one camshaft is in position in the cylinder head and serve the purpose of fastening the cylinder head to the associated cylinder block. A second series of threaded fasteners have their axes lying on a common plane on the other side of the plane containing the cylinder bore axis and spaced inwardly of the axis of rotation of the other camshaft and are accessible when the other camshaft is positioned in the cylinder head for further affixing the cylinder head to the cylinder block.

Other features of the invention are adapted to be embodied in a cylinder head construction for cooperation with a cylinder block, cylinder bore of a internal combustion engine for forming a combustion chamber. The cylinder head has a surface that is adapted to face the cylinder bore. At least a series of three valves seats are formed in the cylinder head surface positioned in substantially part on one side of a plane containing the axis of the associated cylinder bore. These three valve seats are comprised of a center valve seat that is disposed between and further from the plane from the remaining valve seats which comprise side valve seats. A center poppet type valve is slidably supported in the cylinder head and controls the flow through the center valve seat. A pair of side type poppet valves are slidably supported in the cylinder head and control the flow through the side valve seats.

In accordance with a first of these other features, the reciprocal axes of the side poppet type valves lie at acute angles to the plane in a negative direction relative to the plane. The remaining and center poppet type intake valve has its axis disposed substantially less than the acute angles of the side poppet valves and at least parallel to the plane.

In accordance with a second of these other features, each of the valves is operated by a thimble type tappet slidably supported in a respective bore of the cylinder head. The thimble tappet and bore associated with the center intake valve is substantially smaller than the diameters and bores of the tappets for the side poppet valves.

In accordance with a third of these other features, thimble tappets are slidably supported in respective bores in the cylinder head for directly actuating the respective poppet type valves. The thimble tappet that is associated with at least one of the side poppet valves is disposed eccentrically to that popper valve axis and away from the tappet bore associated with the center poppet valve for permitting a larger diameter of the tappets and their supporting bores.

DETAILED DESCRIPTION OF THE PREFERRED EMBODIMENT OF THE INVENTION

Figure 1:
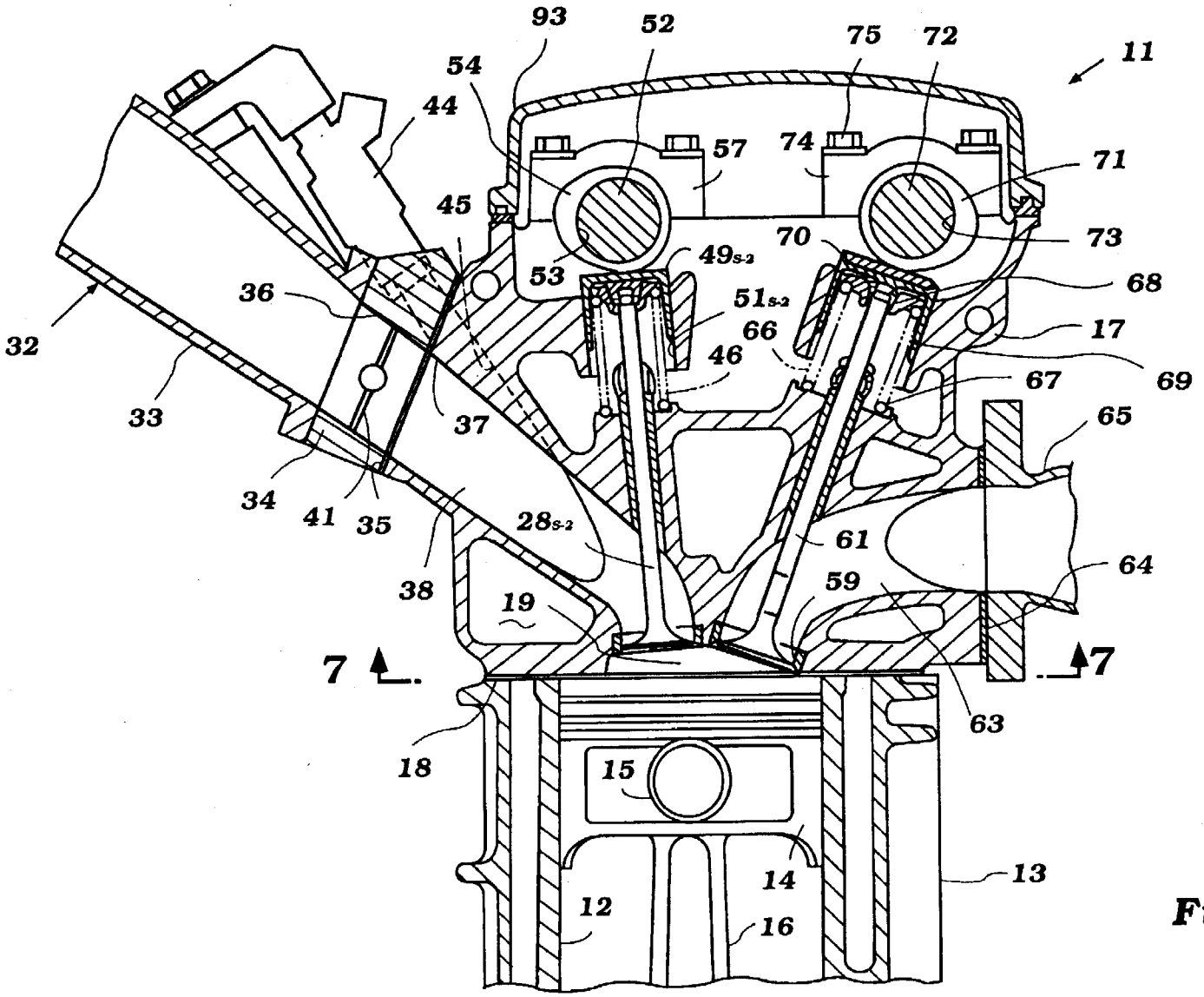
FIG. 1 is a partial cross sectional view taken through a portion of a single cylinder of a multiple cylinder internal combustion engine constructed in accordance with an embodiment of the invention.

Referring now in detail to the drawings and initially to FIG. 1, a portion of an internal combustion chamber is shown partially in cross section and is identified generally by the reference numeral 11. The invention is described, for the most part, in conjunction with the upper portion of the engine associated with one cylinder bore, indicated by the reference numeral 12, since the invention deals primarily with the combustion chamber configuration, the intake and exhaust passages and valve arrangement and the valve actuation. As will become apparent from certain of the other figures, the engine 11 is of the in-line type and has multiple cylinders. However, from the following description, those skilled in the art will readily understand how the invention can be practiced in conjunction with engines having varying cylinder numbers and varying configurations.

Continuing to refer primarily to FIG. 1, the cylinder bore 12 is formed within a cylinder block 13 and slidably supports a piston 14. The piston 14 is connected by means of a piston pin 15 to the upper or small end of a connecting rod 16. The lower end of the connection rod 16 is journaled on a respective throw of a crankshaft (not shown). For the reason aforenoted, this lower end construction is not illustrated and a description of it is not believed necessary to enable those skilled in the art to practice the invention.

A cylinder head 17 is affixed to the cylinder block 13 in a manner which will be described and has a lower surface 18 that is adapted to be held in sealing arrangement with the upper end of the cylinder block 13 with an interposed gasket, if desired. The surface 18 surrounds a recess 19 formed in the cylinder head and which recess cooperated with the cylinder bore 12 and the head of the piston 14 to form a combustion chamber of the engine.

Figure 8:
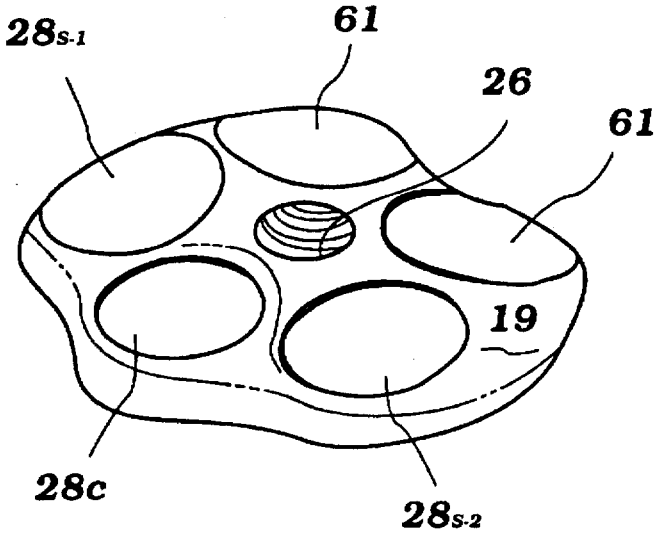
FIG. 8 is a bottom perspective view showing the configuration of the cylinder head combustion chamber recess.
Figure 9:
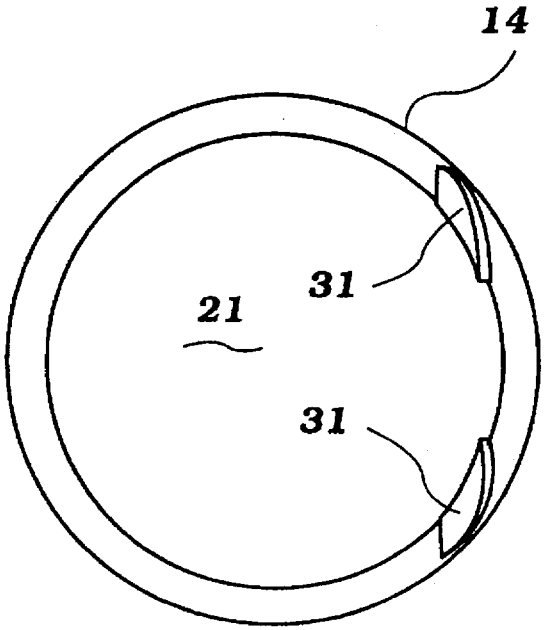
FIG. 9 is a top plane view of the piston of the associated engine showing how it contributes to the configuration of the combustion chamber.

The configuration of the cylinder head recess 19 may be best understood by reference to FIG. 8. This recess 19 cooperates with a bowl 21 formed in the head of the piston 14 as seen in FIG. 9 so as to form what is referred to as a "lens" type combustion chamber.

Referring now additionally to the remaining figures, it will be seen that the cylinder bore 12 has an axis A that passes through generally the center of the cylinder head recess 19 and which defines a plane indicated by the letter L that is parallel to the axis of rotation of the crankshaft and may in fact contain the crankshaft axis. As also may be seen in FIG. 7, the recess 19 is smaller then the diameter of the cylinder bore 12 in many areas and thus forms squish areas 22 and 23 on the intake side, as will become apparent, and a squish area 24 on the exhaust side as will also become apparent. These squish areas function to improve turbulence in the combustion chamber.

Figure 7:
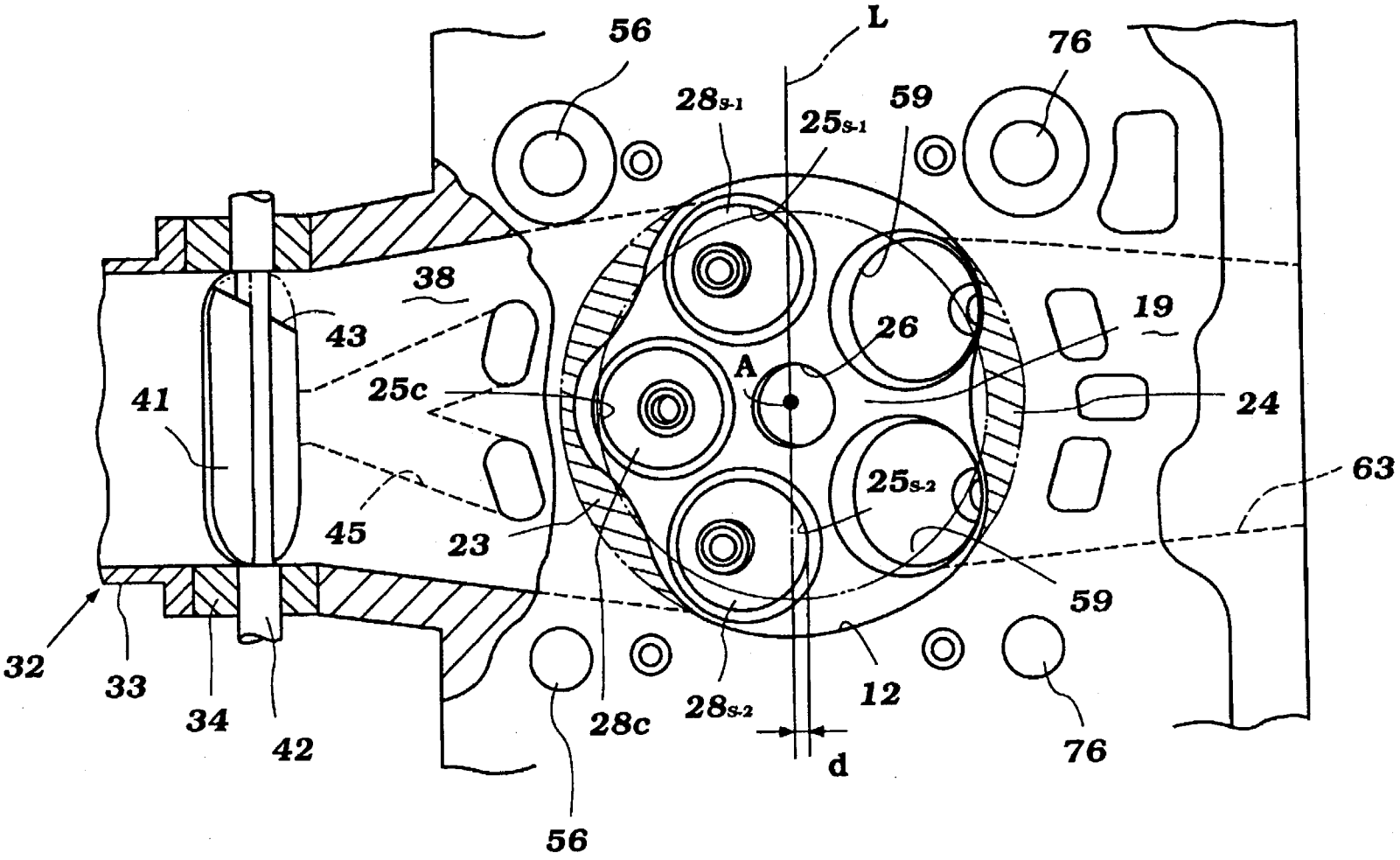
FIG. 7 is a view looking in the direction of the line 7—7 of FIG. 1 and shows the lower portion of the cylinder head, portions of the intake manifold and induction passage are also shown in cross section in this figure.

Referring primarily to FIGS. 7 and 8, it will be seen that a pair of side intake valve seats, indicated by the reference numeral $25s_1$ and $25s_2$ are disposed close to the peripheral edge of the combustion chamber recess 19 and lie so that they extend a brief distance d over the plane L toward the exhaust side of the recess 19. These valve seats $25s_1$ and $25_{s2}$ may have the same or substantially the same diameters.

Disposed between these side intake valve seats $25s_1$ and $25s_2$, is a center intake valve seat $25s_c$. The center intake valve seat 25 is preferably of a slightly smaller diameter than that of the side intake valve seats $25s_1$ and $25s_2$. This center valve seat 25c is disposed further from the plane L and is spaced slightly inwardly from the peripheral edge of the cylinder bore 12 so as to promote the formation of the aforenoted squish areas 22 and 23. Hence, a squish action will be generated so as to direct the flow of charge generally radially inwardly toward the cylinder bore axis A and toward a spark plug well 26 that is formed in the cylinder head and which receives a spark plug 27 which appears in certain of the figures. Hence, the gap the spark plug 27 is disposed substantially centrally of the combustion chamber.

Popper type intake valves, each indicated by the reference numeral 28 and bearing the same suffix as its respective valve seat, are slidably supported in the cylinder head 17 by means of valve guides 29. The support for the side intake valve $28s_2$ and accordingly that of the remaining side intake valve $28s_1$ appears in FIG. 4 while that associated with the center intake valve $28_c$ appears in FIG. 3.

In the illustrated embodiment and since the side intake valves $28s_1$ and $28s_2$ have the same diameters, the axes of reciprocation of these valves defined by the respective valve guides 29 is disposed at an acute angle to the cylinder bore containing axis plan L. This reciprocal axes is indicated by the line $\alpha_s$ in FIG. 4. This angle $\alpha_s$ lies at a relatively shallow acute angle to the plane L. This angle may be considered to be a negative angle viewing the clockwise direction as positive in FIG. 4.

Figure 3:
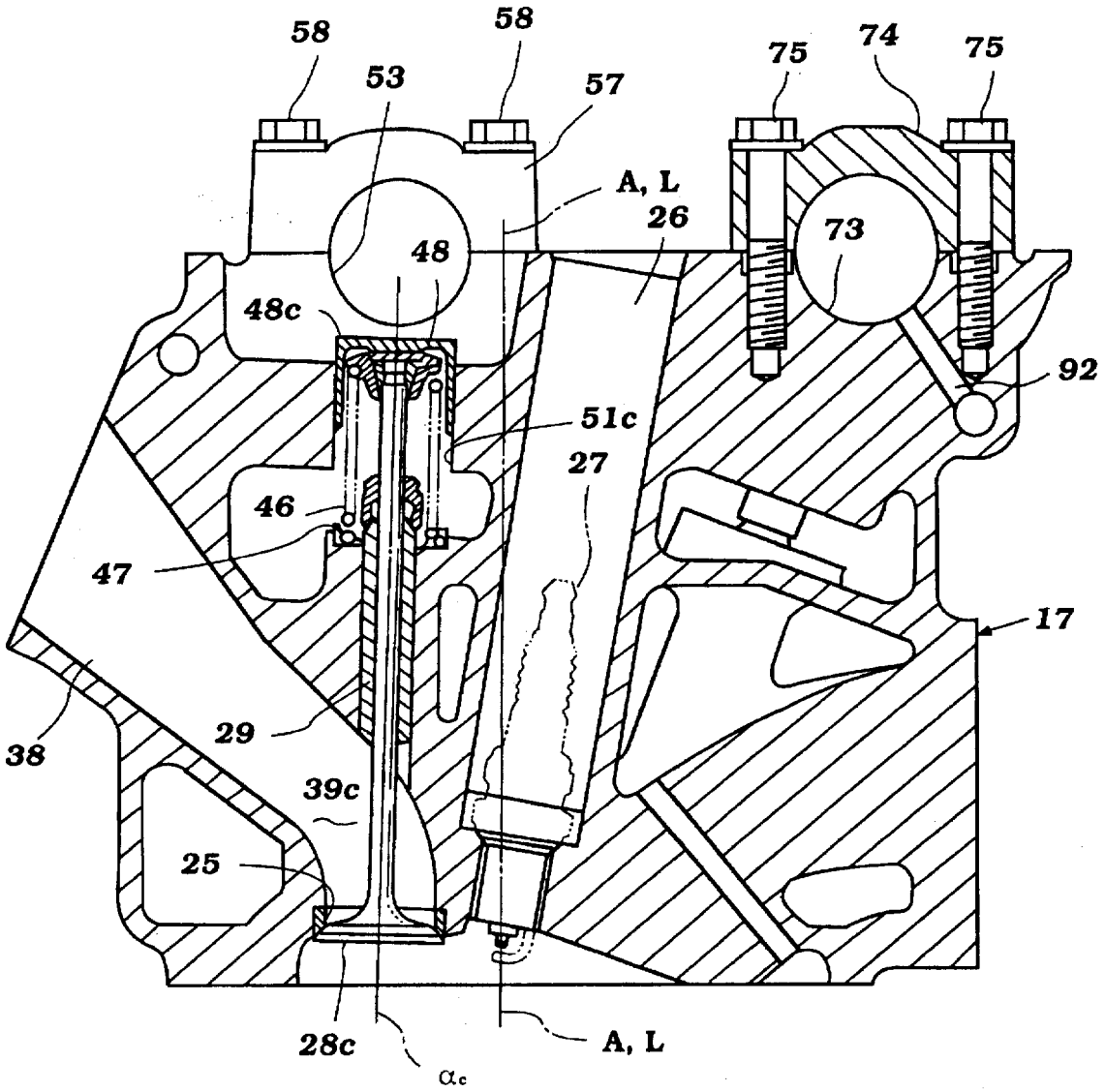
FIG. 3 is a cross sectional view taken along the line 3—3 of FIG. 2, but showing the deleted components, except for the camshafts, in place and shows the arrangement of the center intake valve.

Referring now to FIG. 3, it will be seen that the center popper type intake valve $28_c$ has is reciprocal axis disposed at a substantially lesser or positive angle relative to the plane L and in fact may be at a positive acute angle $\alpha_c$ to the plane L so as to lean toward the opposite side of the cylinder bank. As also seen in this Figure, the spark plug bore 26 is disposed at an acute positive angle to the plane L but on the opposite side of the center intake valve 28 so that the well 26 can accommodate an appropriate size spark plug 27 and so as facilitate servicing.

The described positioning of the intake valves 28 permits the combustion chamber recess 19 to be relatively shallow and also to be provide a relatively small surface area so that high compression ratios and low quenching may be enjoyed. This may be seen from FIG. 8. As may be seen in FIG. 9, the head of the piston 14 outwardly of the bowl 21 is provided with recesses 31 so as to clear the heads of the side intake valves $28s_1$ and $28s_2$ at maximum lift.

An induction system as shown best in FIGS. 1, 3, 4 and 7 is provided for delivering a fuel/air charge to the combustion chamber recess 19 when the respective intake valves 28 are opened. This induction system includes an exhaust manifold, indicated generally by the reference numeral 32, which has individual runners 33 that mate with a control valve assembly 34. The control valve assembly 34 is sandwiched between the individual runners 33 and an outer surface 35 of the cylinder head 17. These components are affixed to each other in a known manner. The control valve assembly 34 has a flow opening 36 which is generally complimentary to a generally oval shaped intake passage opening 37 formed in the cylinder head 17 beginning at the surface 35. This passage 37 has a common portion 38 which branches into individual portions 39 that serve the respective valve seats $25s_1$, $25s_2$ and $25_c$ and which portions are identified by the same subscripts.

A plate type control valve 41 is affixed to a control valve shaft 42 journaled in the body of the control valve assembly 34. The plate type control valve 41 has a cut-out portion 43 which permits high velocity flow to be directed toward the side intake valve seat $25s_1$ when the control valve 41 is in its closed position as shown in FIG. 7. This may be utilized to generate a tumble and/or swirl in the combustion chamber so as to promote better running under low speed, low load conditions.

A fuel injector 44 is mounted in the body of the control valve 34 and has a bifurcated or twin orifice spray nozzle that sprays to a bifurcated channel 45 to deliver fuel toward the two squish areas 22 and 23.

Figure 2:
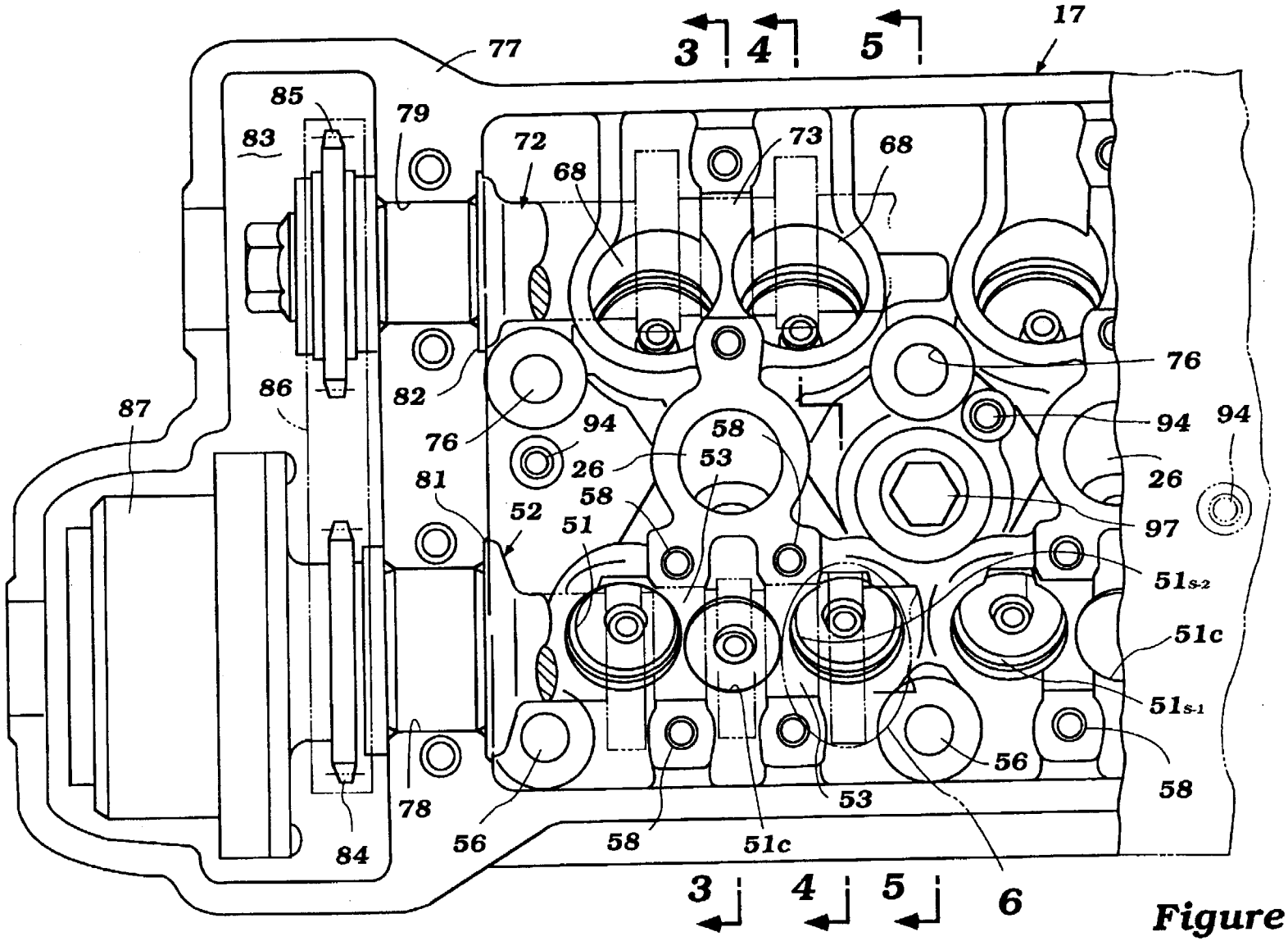
FIG. 2 is an enlarged top plan view of the cylinder head assembly with the cam cover, and portions of the camshafts broken away on the left hand side thereof and with the valve actuating tappets and the valves and valves springs removed so as to more clearly show the cylinder head construction.

The mechanism by which the intake valves 28 are operated and closed will now be described by primary reference to FIGS. 1, 3 and 4 although portions of the construction appear best in FIGS. 2 and 6. Each intake valve 28 has associated with it a respective valve spring 46 that bears against a machined surface 47 formed in the cylinder head 17 around the respective valve guide 29. A keeper retainer assembly 48 loads the opposite end of the spring 46 to the stem of the respective intake valve 28 and urges the intake valve to its closed position. The diameters of the springs 48 are related to the diameters of the heads of the vales which they are associated.

Each valve is operated by means of a respective thimble tappet 49 with the thimble tappets being denoted by suffixes the same as the vales 28 and valve seats 25. These tappets 49 are slidably supported in respective bores 51 formed in the cylinder head 17. It should be seen that the bores 51 are disposed in generally coaxial relation with the stems of the respective valves 28, except as hereinafter noted. The bore $51_c$ associated with the center intake valve $28_c$ and the diameter of its actuating tappet 49 is smaller than those of the side intake valve, indicated by the reference numerals $51s_1$ and $51s_2$ and $49s_1$ and $49s_2$, respectively.

Since the center intake valve $28_c$ is smaller in diameter than that of the side intake valves, it can be operated with a smaller diameter tappet $49_c$ and thus the size of the components is measured with the inertia which they must deal with. This also permits a compact assembly without any sacrifice in strength or life.

To further permit the enlargement of the tappet bodies 49 and the bores 51, the side tappet bodies $49s_1$ and $49s_2$ and their bores, $51s_1$ and $51s_2$ are offset with respect to the centers of the valve stems with which they are associated. This is shown best in FIG. 6 wherein the center of the tappet bore $51s_2$ and the tappet $49s_2$ is indicated at $C_2$ which is offset by the distance e from the center of the associated valve stem. This offset is away from the axis of the center intake valve $28_c$ and thus permits the use of larger tappet bodies than would be possible if this offset were not employed. Hence, the construction provides a high strength and yet a light weight for the overall engine and compact assembly.

An intake camshaft, indicated generally by the reference numeral 52 is rotatably journaled within the cylinder head 17 in a manner to be described. This journal is provided by bearing surfaces 53 formed in bridges that extend between the tappet bodies 49 and which are in part intersected by the tappet bores 51 as best seen in FIG. 2. Individual lobes 54 are formed on the camshaft 52 and cooperate with the thimble tappets 49 for the valve actuation in a known manner.

Figure 6:
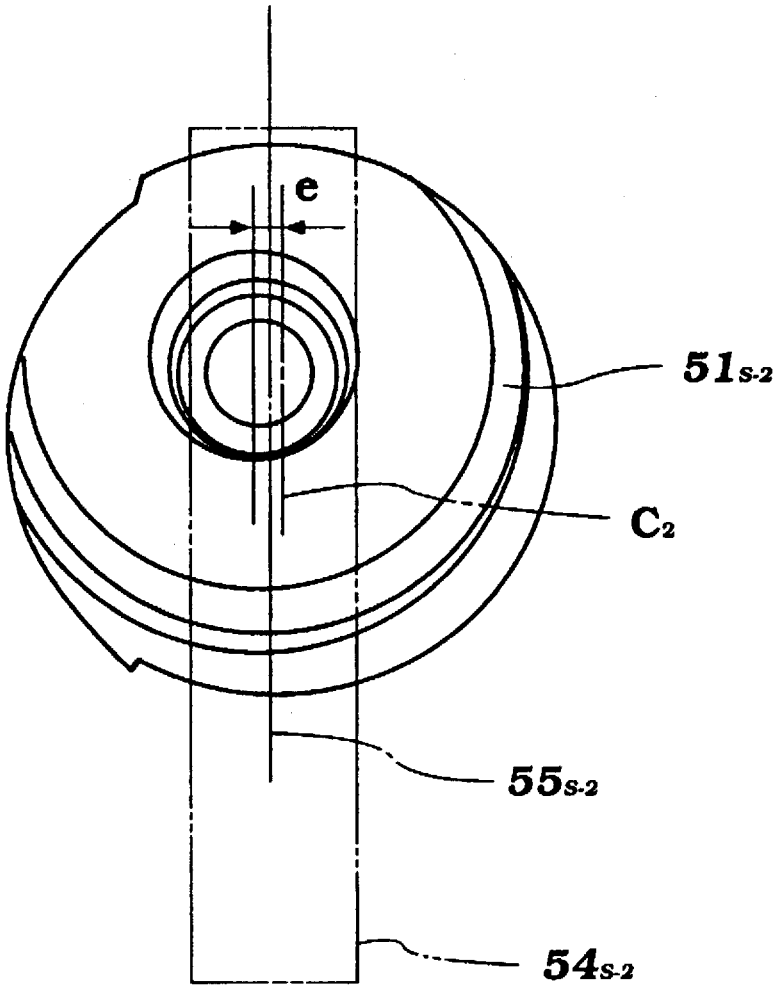
FIG. 6 is an enlarged view of the area encompassed by the circle 6 in FIG. 2.

As may be best seen in FIG. 6, the cam lobes $54s_1$ and $54s_2$ associated with the tappet bodies $49s_1$ and $49s_2$ are also offset from the tappet bore centers $C_2$ but at a smaller distance wherein the center of the cam surface is indicated by the line $55s_2$. Hence, there is a more even loading on the tappet and also a more even loading on the valve stem even though there is this offsetting. The slight offsetting of the cam lobe $54s_1$ and $54s_2$ from the respective tappet $49s_1$ and $49s_2$ will also slightly rotate the tappet during valve actuation so as to make the wearer more uniform.

Figure 5:
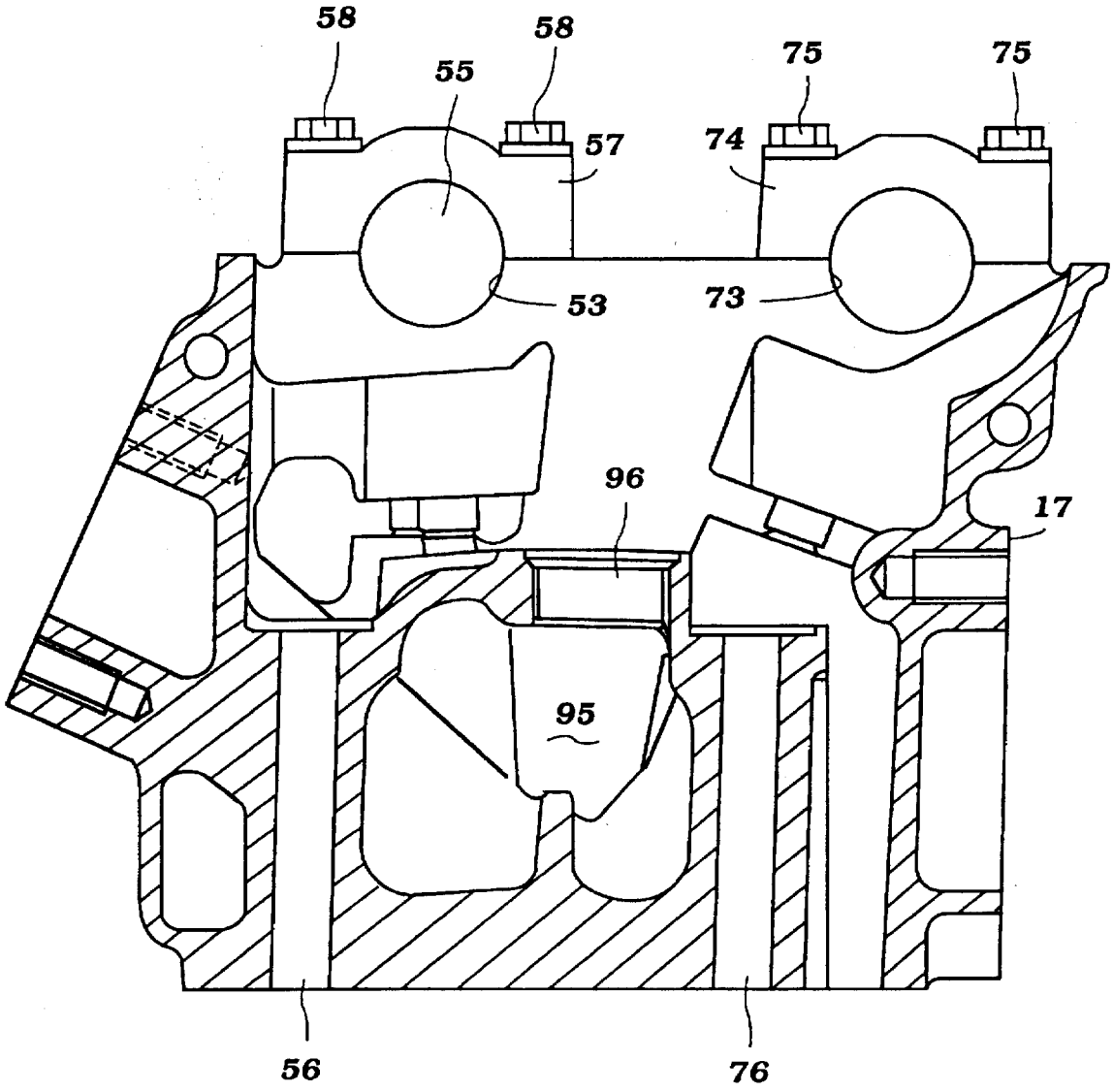
FIG. 5 is a cross sectional view taken along the line 5—5 of FIG. 2 and shows the relationship of the cylinder head fasteners to the camshafts.

As may be best seen in FIG. 5, the positioning of the valves permits the axis of rotation of the intake camshaft 52, which axis is indicated by the line 55 in this figure, so that the cylinder head 17 may be formed with a first series of openings 56 that are disposed transversely outwardly from the axis 55 and a distance such that threaded fasteners may pass through the apertures 56 and their heads may be tighten or loosen without necessitating removal of the intake camshaft 52. The intake camshaft 52 is driven in a manner which will be described later after the exhaust side of the engine has been described.

Bearing caps 57 are affixed to the bridges in which the cam bearing surfaces 53 are formed by threaded fasteners 58 so as to complete the journaling of the intake camshaft 52. It should also be noted that the center of rotation or the rotational axis 55 of the intake camshaft 52 is disposed so that it lies substantially on the planes L, $\alpha_c$ and $\alpha_s$ defined by the respective valves which they operate. This minimizes wear and also permits the outboard positioning of the fastener receiving openings 56 as aforenoted.

Referring now primarily to FIGS. 1, 4, 7 and 8, a pair of exhaust valve seats 59 are provided on the side of the plane L opposite to the intake valve seat 25. These exhaust valve seats 59 are pressed or cast in place like the intake valve seats 25. Poppet type exhaust valves 61 are slidably supported in valve guides 62 and cooperate with the valve seats 59 for controlling the flow therethrough.

Figure 4:
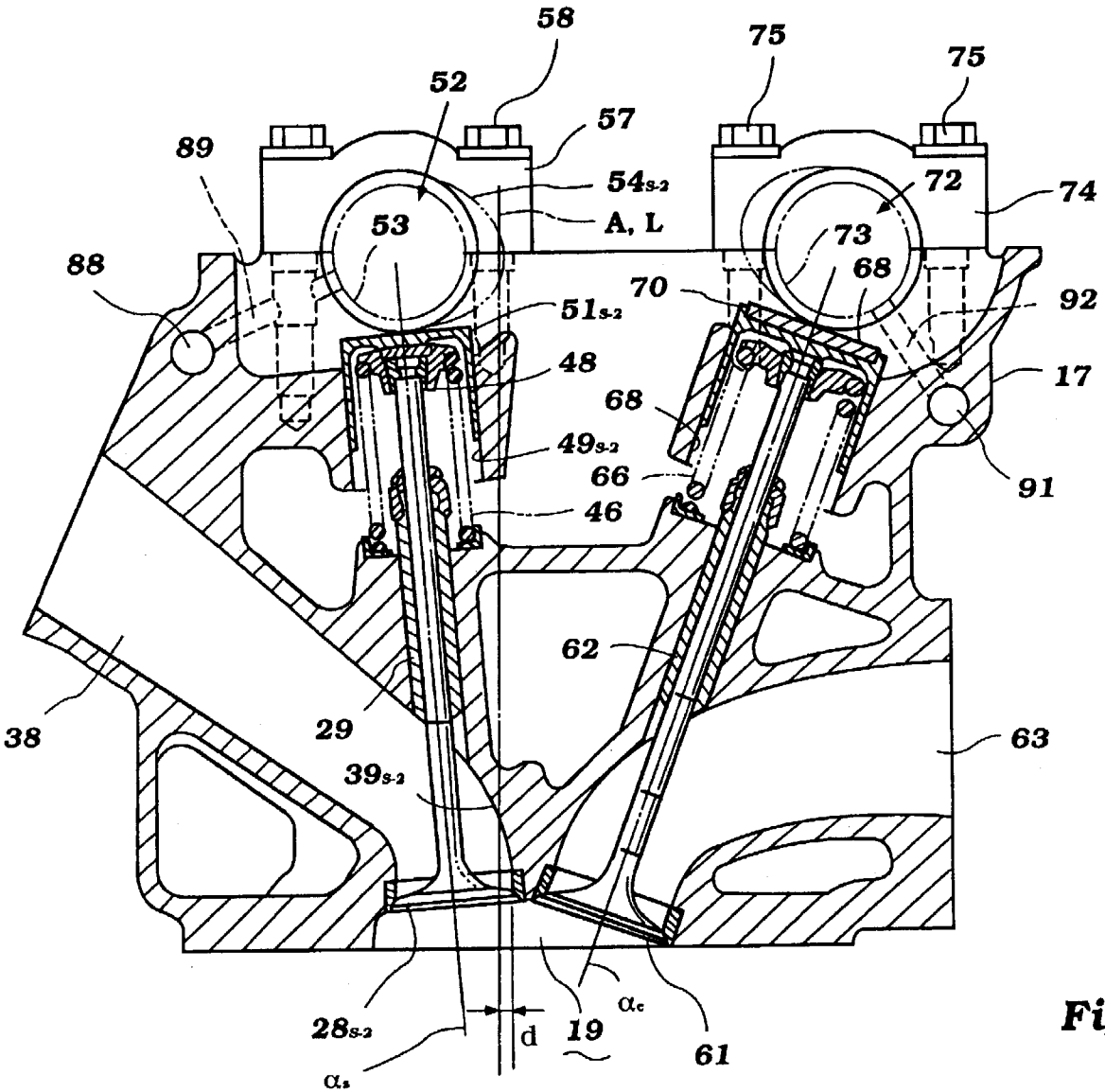
FIG. 4 is a cross sectional view taken along the line 4—4 of FIG. 3 with the components in place and shows the relationship of the side intake valves and the exhaust valves.

As may be best seen in FIGS. 1 and 4, the exhaust valves 61 have their axes $\alpha_e$ disposed at an acute angle to the plane L and in the same direction as the center intake valve axis $\alpha_c$. However, the angle of the axes $\alpha_e$ is substantially greater than that of the center intake valve $\alpha_{2c}$ for a reason which will become apparent.

The exhaust valve seats 59 form the inlet to a Siamese type exhaust passage 63 that extends through the cylinder head 17 on the side opposite the intake passage 38 so as to terminate in an outer surface 64 of the cylinder head. An exhaust manifold 65 is affixed to this surface 64 in a known manner and delivers the exhaust gases to the atmosphere through a suitable exhaust system.

Like the intake valves 28, the exhaust valves 61 are urged to their closed positions by coil compression springs 67 which bear one end against machined surfaces 67 formed in the cylinder head 17 around the valve guides 62. The opposite ends of the springs 67 act against keeper retainer assemblies 68 that are fixed to the upper ends of the stems of the exhaust valves 61 for urging the exhaust valves to their closed positions.

Cylindrical bores 69 are formed in the cylinder head 17 concentrically with the stems of the exhaust valves 61. Thimble tappets 70 are slidably supported therein and cooperate with the valves 61 for opening them. These thimble tappets 70 are actuated by lobes 71 of an exhaust camshaft 72. The exhaust camshaft 72 is journaled in bearing surfaces 73 formed in bridging members that extend between the respective tappet receiving bores 68 as best seen in FIG. 2.

Bearing caps 74 are affixed to the bridging members by threaded fasteners 75 for completing the journaling of the exhaust camshaft 72. The exhaust camshaft 72 has its rotational axis disposed well outwardly of the plane L so that threaded fastener receiving openings 76 may be formed in the cylinder head 17 at the same distance from the plane L and from the cylinder bore axis A as the threaded fastener receiving openings 56. A second series of threaded fasteners extend through these openings 76 for affixing the cylinder head 17 to the cylinder block 14. Like those threaded fasteners that are received in the openings 56, the heads of these threaded fasteners may be accessed for tightening without removing the exhaust camshaft 72.

The drive for the intake camshaft 52 and exhaust camshaft 72 will now be described by reference to FIG. 2. It will be seen that the cylinder head 17 is formed with a forward wall 77 that is disposed forwardly of the camshafts and which defines bearing surfaces 78 and 79 which journal the forward ends of the intake and exhaust camshafts 52 and 72. Bearing caps (not shown) are affixed to this cylinder head wall 77 in a known manner. The intake and exhaust camshafts 52 and 72 have thrust bearing portions 81 and 82, respectively, that cooperate with the wall 77 to axially locate these camshafts.

A cam driving chamber 83 is formed forwardly of the wall 77. A pair of sprockets 84 and 85 are driven from the crankshaft by a flexible transmitter such as a chain 86 in a known matter. This drive provides a 2 to 1 speed reduction and may be in one or more stages.

The exhaust camshaft driving sprocket 85 is rigidly affixed to the exhaust camshaft 72. On the other hand, the intake camshaft driving sprocket 84 is connected to the intake camshaft 52 through a variable valve timing mechanism 87 which may be of any known type. As is known in this art, this permits the variation in timing between the intake and exhaust camshafts 52 and 72 to provide better running throughout the entire engine speed and load ranges without sacrificing maximum performance.

A lubricating mechanism for provided for lubricating the bearing surfaces 53 and 73 and the intake and exhaust camshafts 52 and 72, respectively. The intake side lubricating system includes a main gallery 88 that is drilled through the cylinder head and which is intercepted by a plurality of drillings 89 one for each intake camshaft bearing surface 53. These drillings 89 intersect the openings through which the threaded fasteners 58 pass so as to provide a short lubricant path without restriction.

A main oil gallery 91 is formed on the exhaust side of the cylinder head and it also is intersected by drilled passages 92 that extend to the exhaust camshaft bearing surfaces 73. Since the exhaust camshaft 72 is disposed outboard of the intake camshaft 52, it is not necessary for the drillings 92 to pass through the openings for the threaded fasteners 75. Oil is supplied to the main galleries 88 and 91 in any suitable manner.

Finally, a cam cover 93 is affixed to the cylinder head 17 by means of threaded fasteners 94 which are tapped into suitable openings in the cylinder head.

In the illustrated embodiment, the engine 17 is water cooled and cooling jackets are formed in the cylinder block and cylinder head. The cylinder head cooling jacket appears in certain of the figures and is identified by the reference numeral 95. A clean-out opening 96 in the upper surface of the cylinder head permits removal of sand after casting. This opening is then closed by a clean-out plug 97 such as a a threaded fastener or the like.

From the described construction, it should be readily apparent that the cylinder head and valve actuating mechanism permits a very compact assembly and yet one that permits the use of five valves per cylinder while still maintaining an easy arrangement for holding down the cylinder head and for permitting re-torquing of it without removal of the camshafts. Of course, the foregoing description is that of a preferred embodiment of the invention and various changes and modifications may be made without departing from the spirit and scope of the invention, as defined by the appended claims.

What is claimed is:

1. An internal combustion engine comprised of a cylinder block forming at least one cylinder bore, a cylinder head defining a combustion chamber recess in facing relationship to and closing said cylinder bore to form a combustion chamber, a plurality of intake valves supported on one side of said cylinder head recess for reciprocation in said cylinder head for controlling the admission of a charge to said combustion chamber, a plurality of exhaust valves supported on the other side of said cylinder head recess for reciprocation in said cylinder head for controlling the discharge of a burnt charge from said combustion chamber, an intake cam shaft rotatably journaled by said cylinder head along a longitudinally extending axis and associated with said intake valves for operating said intake valves, an exhaust cam shaft rotatably supported by said cylinder head about an axis parallel to the axis of said intake cam shaft and associated with said exhaust valves for operating said exhaust valves, one of said cam shaft rotational axes being disposed substantially closer to a plane containing the axes of the cylinder bore than the other of said cam shafts, a first series of threaded fasteners for fixing said cylinder head to said cylinder block having their axes lying on a plane spaced outwardly of the axis of said one cam shaft and being accessible when said one cam shaft is in position in said cylinder head, and a second series of threaded fasteners fixing said cylinder head to said cylinder block having their axes lying on a plane spaced inwardly of the axis of the other of said cam shafts and being accessible when said other cam shaft is in position in said cylinder head.

2. An internal combustion engine as set forth in claim 1, wherein one of the plurality of valves contains more valves than the other of the plurality of valves.

3. An internal combustion engine as set forth in claim 2, wherein the one cam shaft is associated with the plurality of valves having the greater number of valves.

4. An internal combustion engine as set forth in claim 3, wherein the greater number of valves comprise intake valves.

5. An internal combustion engine as set forth in claim 4, wherein the intake valves comprise a pair of side intake valves disposed closer to a plane containing the axis of the cylinder bore and extending between and parallel to the axes of rotation of the cam shaft and a third center intake valve disposed between said side intake valves and positioned further from said plane containing said cylinder bore axis than said side intake valves, said side intake valves having their axes of reciprocation disposed at acute angles inclined said plane and the center intake valve having its reciprocal axis disposed so that it does not incline toward said plane.

6. An internal combustion engine as set forth in claim 5, further including a plurality of tappets each associated with a respective one of the intake valves for operating the intake valves and wherein the tappet associated with the center intake valve has a smaller diameter than the tappets associated with the side intake valves.

7. An internal combustion engine as set forth in claim 6, wherein the tappets associated with the side intake valves are offset from the center of the respective intake valves in a direction from the center intake valve.

8. An internal combustion engine as set forth in claim 1, wherein the valves are all operated directly by the lobes of the respective cam shafts.

9. An internal combustion engine as set forth in claim 8, wherein the valves are operated directly through thimble tappets.

10. An internal combustion engine as set forth in claim 9, wherein one of the plurality of valves contains more valves than the other of the plurality of valves.

11. An internal combustion engine as set forth in claim 10, wherein the one cam shaft is associated with the plurality of valves having the greater number of valves.

12. An internal combustion engine as set forth in claim 11, wherein the greater number of valves comprise intake valves.

13. An internal combustion engine as set forth in claim 12, wherein the intake valves comprise a pair of side intake valves disposed closer to a plane containing the axis of the cylinder bore and extending between and parallel to the axes of rotation of the cam shaft and a third center intake valve disposed between said side intake valves and positioned further from said plane containing said cylinder bore axis than said side intake valves, said side intake valves having their axes of reciprocation disposed at acute angles inclined toward said plane and the center intake valve having its reciprocal axis disposed so that it does not incline toward said plane.

14. An internal combustion engine as set forth in claim 9, wherein the combustion chamber recess and an associated piston in the cylinder bore define a lens-shaped combustion chamber when the piston is at top dead center.

15. An internal combustion engine as set forth in claim 14, wherein the greater number of valves comprise intake valves.

16. An internal combustion engine as set forth in claim 15, wherein the intake valves comprise a pair of side intake valves disposed closer to a plane containing the axis of the cylinder bore and extending between and parallel to the axes of rotation of the cam shaft and a third center intake valve disposed between said side intake valves and positioned further from said plane containing said cylinder bore axis than said side intake valves, said side intake valves having their axes of reciprocation disposed at acute angles inclined toward said plane and the center intake valve having its reciprocal axis disposed so that it does not incline toward said plane.

17. An internal combustion engine as set forth in claim 14, further including a plurality of tappets each associated with a respective one of the intake valves for operating the intake valves and wherein the tappet associated with the center intake valve has a smaller diameter than the tappets associated with the side intake valves.

18. An internal combustion engine as set forth in claim 17, wherein the tappets associated with the side intake valves are offset from the center of the respective intake valves in a direction from the center intake valve.

19. An internal combustion engine as set forth in claim 15, wherein the tappets associated with the side intake valves are offset from the center of the respective intake valves in a direction toward the center intake valve.

20. A cylinder head construction for cooperation with a cylinder bore of a cylinder block of an internal combustion engine to form a combustion chamber, said cylinder head having a surface adapted to face said cylinder bore, at least a series of three valve seats formed in said surface positioned in substantial part on one side of a plane containing the axis of said cylinder bore, said three valve seats being comprised of a center valve seat disposed further from said plane and between said remaining valve seats which comprise side valve seats, a center poppet type valve supported for reciprocation within said cylinder head for controlling the flow through said center valve seat, a pair of side poppet valves supported for reciprocation within said cylinder head for cooperation with said side valve seats for controlling the flow therethrough, said center poppet valve reciprocal axis being disposed in the direction of closing of said center poppet valve at no less than a parallel relationship to the plane so that the head of said center poppet valve is either perpendicular to said plane or faces slightly away from said plane and the reciprocal axes of said side poppet valves being inclined toward said plane in the direction of closing of said side poppet valves so that the heads of said side poppet valves face toward said plane.

21. A cylinder head as set forth in claim 20, further including a plurality of tappets each associated with a respective one of the valves for operating the valves and wherein the tappet associated with the center valve has a smaller diameter than the tappets associated with the side valves.

22. A cylinder head as set forth in claim 21, wherein the tappets associated with the side valves are offset from the center of the respective valves in a direction from the center valve.

23. A cylinder head as set forth in claim 20, wherein the reciprocal axes of the side intake valves lie at the same angle to the plane.

24. A cylinder head as set forth in claim 20, wherein the head of the center intake valve has a smaller diameter than the head of the side intake valve.

25. A cylinder head as set forth in claim 20, wherein the reciprocal axes of the side intake valves lie at the same angle to the plane.

* * * * *